United States Patent [19]

Dilmore et al.

[11] 4,186,065

[45] Jan. 29, 1980

[54] METHOD OF PREPARING A RESIN-CONTAINING ASBESTOS DIAPHRAGM

[75] Inventors: Colonel R. Dilmore, New Martinsville; Edsel V. Hoover, Paden City; Allan B. Kriss, New Martinsville, all of W. Va.

[73] Assignee: PPG Industries, Inc., Pittsburgh, Pa.

[21] Appl. No.: 900,456

[22] Filed: Apr. 27, 1978

[51] Int. Cl.[2] ..... C25B 1/16; C25B 1/26; C25B 13/06; C25B 13/08

[52] U.S. Cl. ..... 204/98; 204/295; 204/296; 204/128

[58] Field of Search ..... 204/296, 295

[56] References Cited

U.S. PATENT DOCUMENTS

| | | | |
|---|---|---|---|
| 3,276,989 | 10/1966 | Nishihara et al. | 204/296 |
| 3,291,632 | 12/1966 | Nielsen | 204/296 |
| 3,694,281 | 9/1972 | Leduc | 156/77 |
| 3,694,310 | 9/1972 | Emanuelson et al. | 204/296 |
| 3,723,264 | 3/1973 | Leduc et al. | 204/80 |
| 3,991,251 | 11/1976 | Foster et al. | 204/295 |
| 4,031,041 | 6/1977 | Bouy et al. | 204/296 |
| 4,065,534 | 12/1977 | Rechlicz et al. | 204/296 |

*Primary Examiner*—R. L. Andrews
*Attorney, Agent, or Firm*—Richard M. Goldman

[57] ABSTRACT

Disclosed is a method of preparing a resin-containing asbestos diaphragm. The diaphragm is prepared by depositing asbestos fibers and resin from an aqueous slurry onto a liquid permeable cathode and subsequently heating the deposited asbestos fibers and resin to cause the resin to bond the asbestos fibers together. As disclosed, air flow is maintained through the diaphragm until the diaphragm is substantially free of entrained water. The heated air is maintained at a temperature below the boiling temperature of entrained water so as to avoid boiling the entrained water.Thereafter, the temperature of the deposited diaphragm is heated to cause the resin to bind the asbestos fibers together.

69 Claims, 4 Drawing Figures

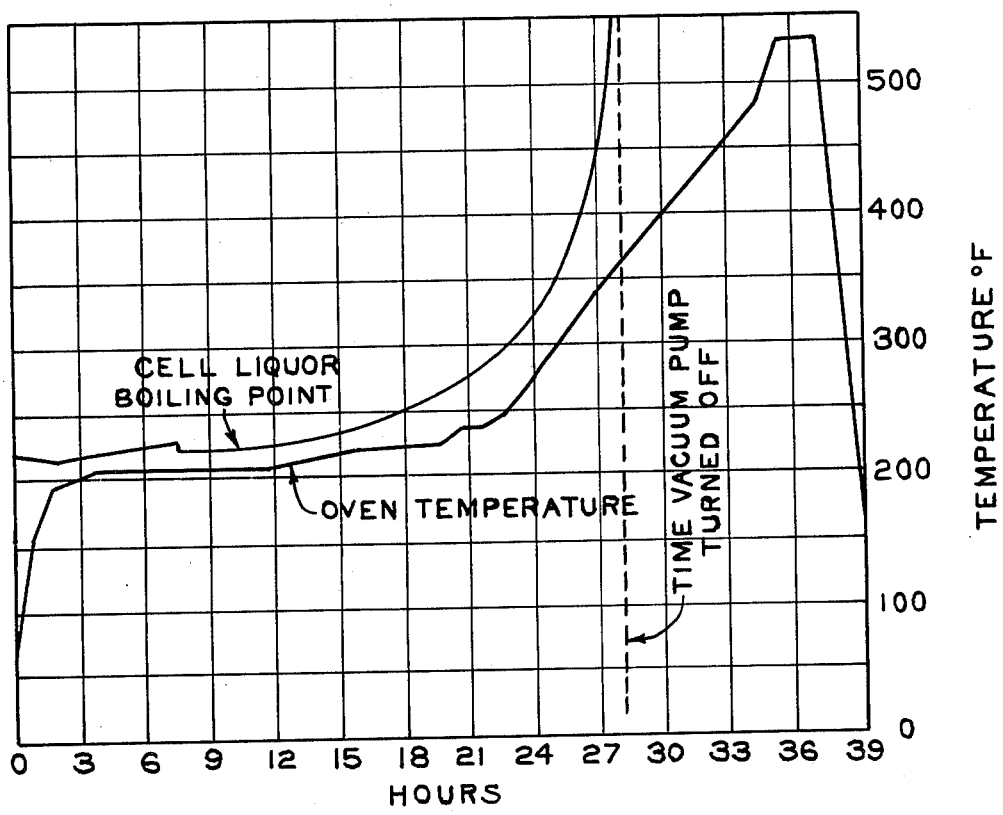
FIG. 1
FIG. 2
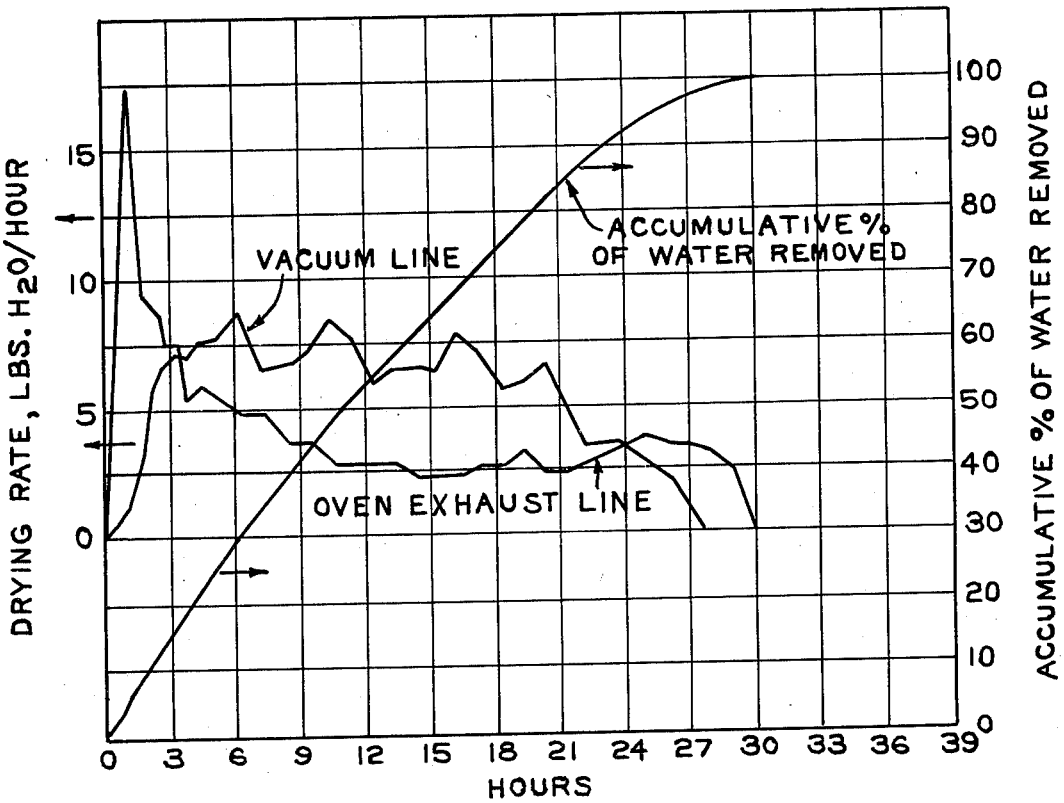

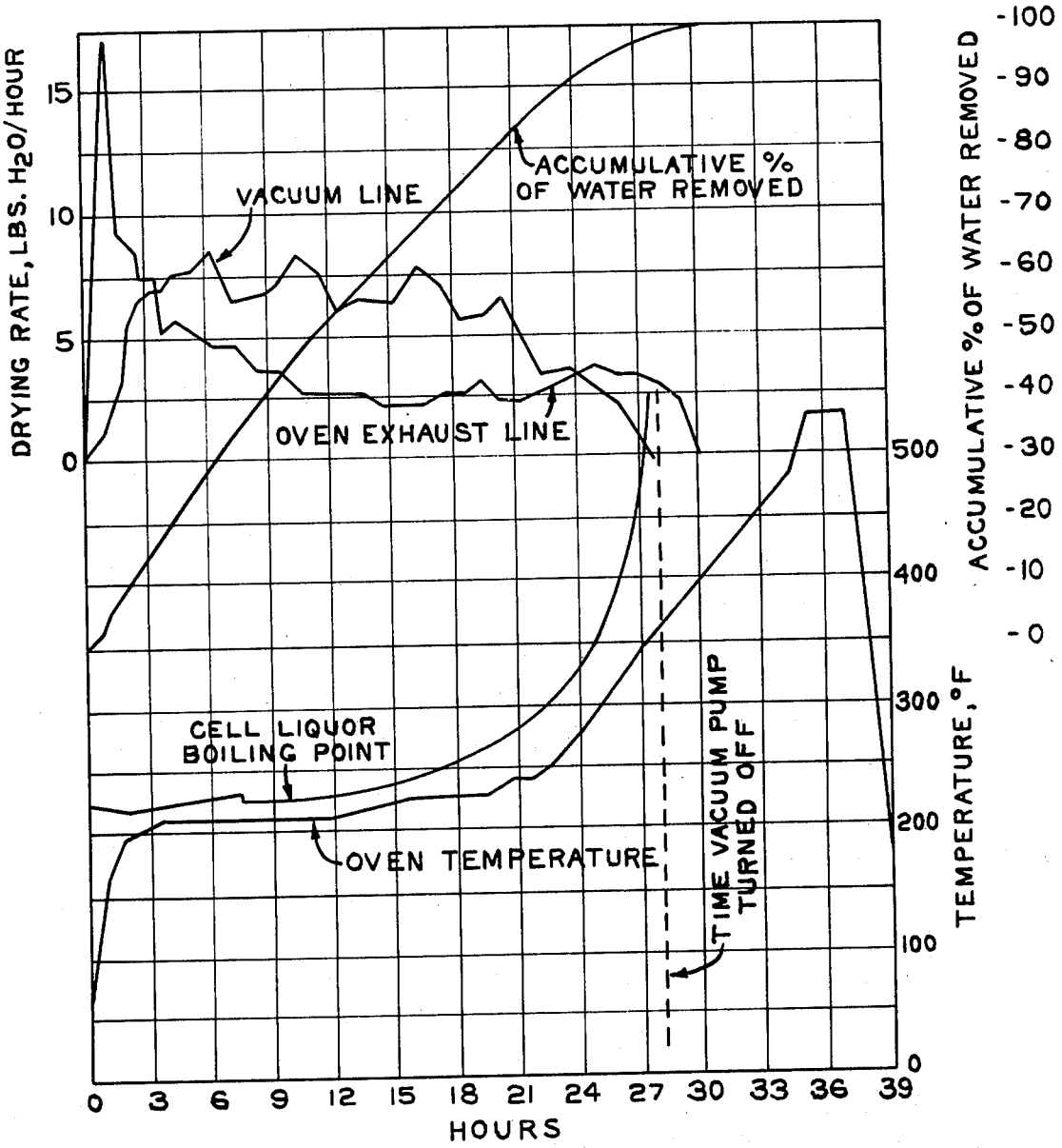
FIG. 3
FIG. 4
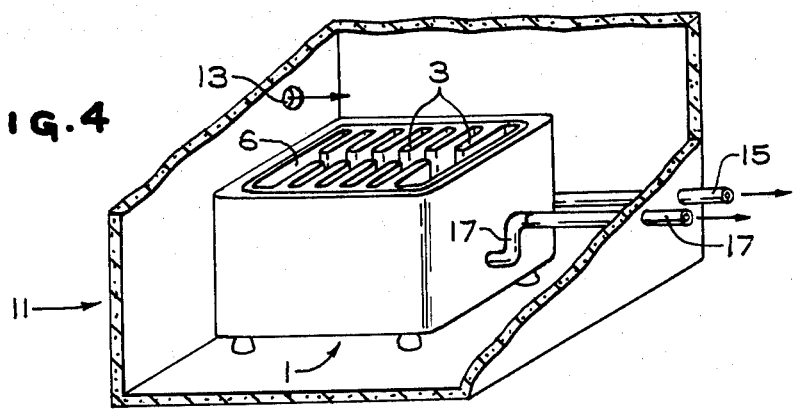

METHOD OF PREPARING A RESIN-CONTAINING ASBESTOS DIAPHRAGM

DESCRIPTION OF THE INVENTION

Diaphragms are used in electrochemical processes to separate an anolyte liquor from a catholyte liquor while permitting bulk flow of electrolyte therethrough. Diaphragms are used, for example, to separate an oxidizing electrolyte from a reducing electrolyte or a concentrated electrolyte from a dilute electrolyte, or a basic electrolyte from an acidic electrolyte.

In the electrolysis of alkali metal halide, the diaphragm separates an acidic anolyte from an alkaline catholyte. Historically, commercial chlor-alkali diaphragms have been made of asbestos. Asbestos diaphragms are characterized by a short life, for example, on the order of about 6 to 8 months. Attempts to extend the life of asbestos diaphragms while maintaining desirable electrical properties have included the use of various polymers and resins within the asbestos mat. Such asbestos-resin combinations have been prepared by codeposition of the polymer with the asbestos or by application of the polymer to the deposited asbestos. Thereafter, the polymer-containing asbestos has been heated to a temperature sufficient to soften the polymer, causing the liquid polymer to flow over the asbestos fibers, binding the asbestos fibers together.

It has surprisingly been found that a particularly satisfactory diaphragm may be prepared by heating a thermoplastic resin-containing diaphragm to evaporate the entrained water within the codeposited asbestos and resin while maintaining the temperature of the entrained water, which is actually an aqueous solution of alkali metal chloride and alkali metal hydroxide, below the boiling point thereof. This provides a particularly uniform diaphragm characterized by the substantial absence of any blisters, holes, or other non-uniformities.

According to the method of this invention, an improved thermoplastic resin-containing asbestos diaphragm is provided. This asbestos diaphragm has a particularly high degree of uniformity. The polymer may either be a hydrocarbon, a halogenated hydrocarbon, or a halocarbon.

According to the method of this invention, the asbestos and resin are codeposited from an aqueous slurry of alkali metal hydroxide and alkali metal chloride. Thereafter, the wet, codeposited asbestos fibers and resin are heated at a temperature high enough to evaporate the water of the entrained aqueous solution but low enough to avoid boiling of the entrained solution.

As used herein, the term "asbestos" includes chrysotile asbestos, cristobalite asbestos, amphibole asbestos, and serpentine forms of asbestos. As used herein, the term "thermoplastic" as applied to the resin means those polymeric materials that are capable of being melted to form a liquid or a tacky solid without significant degradation and thereafter being cooled to form a solid material. As used herein, a "discontinuous film" on the asbestos fibers refers to a film formed by the molten or liquid resin or the tacky solid resin on the individual asbestos fibers and fibriles and within the individual fibriles after cooling and solidification of the resin.

THE FIGURES

The method of this invention may be understood by reference to the Figures.

FIG. 1 shows a curve of temperature of the air fed to the drying oven versus time plotted on the same time and temperature scales as the boiling point of the liquor entrained in the wet mat.

FIG. 2 shows, on the left-hand scale, the drying rate, in pounds of water per hour, of water removed through the external surface of the diaphragm via the furnace exhaust and as water from the inside of the cathode finger via a vacuum line attached to the cathode. FIG. 2 also shows, on the right-hand scale, the cumulative percentage of entrained water removed from the fibrous asbestos mat through both the vacuum line from within the cathode finger and the furnace exhaust line.

FIG. 3 shows FIGS. 1 and 2 combined on the same time scale.

FIG. 4 shows a cathode assembly in a drying oven with a vacuum line for drawing air through the wet fibrous asbestos mat.

DETAILED DESCRIPTION OF THE INVENTION

The invention relates to a method of preparing a resin-containing asbestos diaphragm. According to the method of this invention, asbestos fibers and resin are deposited onto a liquid permeable body, e.g., a cathode, from an aqueous slurry containing alkali metal chloride, alkali metal hydroxide, asbestos fibers, and resin. Thereafter, the wet mat of deposited asbestos fibers and resin is heated to bind the asbestos fibers together. However, prior to melting the resin, the mat is subjected to the forced convective flow of air around and through the mat at a temperature below the boiling temperature of the entrained water within the wet mat. This avoids boiling of the entrained water. When the mat is substantially free of entrained water, its temperature is increased high enough to cause the resin to flow and bind the asbestos fibers together.

According to the method of this invention, the convective flow of air is maintained through the wet asbestos mat while the temperature of the air is maintained below the boiling point of the cell liquor entrained within the wet mat, but high enough to evaporate the water content of the entrained cell liquor. This may be done by initially applying a low vacuum, for example, a vacuum of from about 2 inches of mercury (50 mm Hg) to about 15 inches of mercury (375 mm Hg) and generally from about 5 inches of mercury (125 mm Hg) to about 10 inches of mercury (250 mm Hg) to the inside of the cathodes while slowly increasing the temperature from ambient temperature to about 210° F. (99° C.), for example, over a period of about 2 hours. Thereafter, while maintaining a vacuum of about 4 to about 6 inches of mercury (120 to 180 mm Hg), the temperature is maintained between about 210°–220° F. (99°–100° C.) until the air passed through and recovered from the deposited asbestos fibers and resin has a relative humidity of less than about 20 percent and preferably as low as about 1 percent. For example, the wet asbestos mat may be maintained at a temperature of about 210°–212° F. (99°–100° C.) until the relative humidity of the air, described above, is less than about 20 percent and thereafter the temperature of the wet asbestos mat may be increased to about 220° F. (104° C.) and maintained thereat until the relative humidity of the air passed through and recovered from the wet deposited asbestos fibers and resin is below about 1 percent.

The temperature of the air passed through the wet asbestos mat should be maintained at about 210° F. (99°

C.) for at least as long as the absolute humidity of the air recovered therefrom is constant, e.g., at about 0.07 to 0.10 pounds of moisture per pound of dry air, and preferably until a further downward trend in the absolute humidity of the air is shown at constant air flow rate. That is, the temperature of the air passed through the wet mat should be maintained at about 210° F. (99° C.) at least as long as the rate of evaporation when measured at a constant flow rate is constant and preferably until the rate of evaporation when measured at a constant flow rate begins to diminish. This procedure may then be repeated, stepwise, for successive periods at successively higher temperatures until temperatures are attained at which the resin is susceptible to softening and flowing.

When the temperature of the air drawn or forced through the wet asbestos mat is referred to herein, it is to be understood that this temperature may differ from the temperature of the air inlet to the furnace or drying chamber. The temperature of the air drawn through the wet asbestos mat is approximated by the dry bulb temperature of the air recovered therefrom.

After the absolute moisture content of the air recovered from wet asbestos mat, when measured at constant flow rate, has diminished to negligible levels, the temperature of the air drawn or forced through the wet asbestos mat may be increased, for example, up to the melting or softening temperature of the resin. However, in order to avoid blistering, the rate of temperature increase should be low enough to maintain a constant or even diminishing rate of evaporation of water from the wet mat.

The temperature may be increased slowly, for example, to above about 350° F. (177° C.) to 480° F. (250° C.). During this time, the vacuum is maintained. However, as the temperature approaches the softening temperature or melting temperature of the resin, the vacuum should be reduced and the pressure between the two sides of the mat equalized, for example, by disconnecting the vacuum as the mat approaches the melting temperature of the resin. This is to avoid causing the melting or flowable resin from flowing to one side or the other of the mat. Thereafter, the mat is heated above the melting point of the resin and then slowly allowed to cool whereby to provide a resin-reinforced asbestos diaphragm.

The flow rate of heated air through the diaphragm is a function of the pressure differential across the diaphragm, the porosity of the diaphragm, and the thickness of the diaphragm. The flow rate should be high enough to avoid saturation of the air drawn through the diaphragm but low enough to avoid any damage to the diaphragm. Flow rates of from about $0.5\times10^{-2}$ pounds of air per square foot of diaphragm area ($2.4\times10^{-3}$ gm/cm$^2$) to about $5.0\times10^{-2}$ pounds of air per square foot of diaphragm area ($2.4\times10^{-2}$ gm/cm$^2$), and preferably from about $0.75\times10^{-2}$ pounds of air per square foot of diaphragm area ($3.65\times10^{-2}$ gm/cm$^2$) to about $1.25\times10^{-2}$ pounds of air per square foot of diaphragm area ($6.08\times10^{-2}$ gm/cm$^2$).

While the method of causing the convective flow of heated air through the deposited wet asbestos fibers and resin has been described with reference to maintaining a vacuum within the cathode fingers, it is to be understood that other equivalent ways may be utilized in order to cause the convective flow of the heated air through the deposited asbestos fingers as well as to cause flow air to contact the back side of the diaphragm, i.e., the side of the diaphragm facing the cathode.

The air flowing through the codeposited asbestos fibers and resin diaphragm is maintained at a temperature below the boiling point of the entrained water within the diaphragm but high enough to evaporate the water until the diaphragm is substantially free of entrained water. That is, until in excess of 60 percent of the entrained water, and preferably in excess of 90 percent or even 99 percent of the entrained water, is removed. This is done in order to avoid boiling the entrained cell liquor.

By maintaining the diaphragm temperature or the temperature of the air passing through the diaphragm below about 220° F. (104° C.) and preferably between 210° F. (99° C.) and 212° F. (100° C.) until the relative humidity of the air passed through the diaphragm and recovered therefrom is less than 20 percent, and thereafter increasing the temperature of the air to about 220° F. (104° C.) until the relative humidity of the air recovered from the deposited asbestos fibers and resin is about 1 percent or less, the boiling of the entrained water is avoided along with the consequent blistering of the asbestos diaphragm. This is continued stepwise until substantially all of the entrained water is removed from the asbestos mat.

Thereafter, the codeposited asbestos fibers and resin diaphragm may be heated to cause the resin to flow and bind the asbestos fibers together.

After the resin has melted and started to flow, the mat is maintained above the melting point of the resin for at least about 30 minutes to about 2 hours. The cathode element, with the diaphragm thereon, is then permitted to cool, e.g., to ambient temperature.

Thereafter, the electrolytic cell may be assembled. The method of this invention may result in an undesirably low diaphragm porosity because of the presence of salt particles in the diaphragm. For this reason, an electrolytic cell having the resin reinforced asbestos diaphragm of low permeability may be started up by feeding water to the anolyte compartment of the cell to a level sufficient to thoroughly wet the diaphragm. Thereafter, brine may be fed to the anolyte compartment and a dilute brine withdrawn from the catholyte compartment without the passage of electrical current through the cell. This increases the liquid permeability of the diaphragm. Thereafter, the flow of electrical current through the cell and electrolysis are commenced.

In preparing a diaphragm according to the method of this invention, an aqueous slurry containing asbestos, the resin, alkali metal hydroxide, and alkali metal chloride is prepared. The slurry is drawn through a liquid permeable member with the asbestos and resin codeposited on the liquid permeable member and forming a fibrous asbestos mat. Thereafter, the fibrous asbestos mat is slowly heated to evaporate the entrained cell liquor while avoiding the boiling thereof. As water is evaporated from the entrained cell liquor, the concentration of the entrained cell liquor increases thereby raising the boiling point thereof and reducing the vapor pressure of the remaining water.

The asbestos used is generally chrysotile asbestos. The size of the asbestos is Quebec Asbestos Producers Association screen test grades 3 and 4.

The slurry contains from about 0.5 to about 3 weight percent asbestos, basis total weight of the liquid and solids, and from about 2 to about 80 weight percent resin, basis weight of asbestos and resin, and generally from about 0.1 to about 10 weight percent of a surfactant, basis weight of the resin. Concentrations of asbestos lower than about 0.5 weight percent, basis total weight of the liquid and solids, while satisfactory in providing a diaphragm according to this invention, require large throughputs of slurry in order to build up a satisfactory thickness of the asbestos. Asbestos concentrations greater than about 3 weight percent asbestos in the slurry generally result in substantial settling out of the asbestos in the slurry and a non-uniform diaphragm.

The slurry has a pH greater than 7 and preferably greater than about 10. The alkaline pH is provided by an aqueous solution containing hydroxide ion. The solution may be provided by sodium hydroxide and sodium chloride or by potassium hydroxide and potassium chloride. Generally, the slurry contains from about 100 to about 200 grams per liter alkali metal hydroxide and from about 100 to about 300 grams per liter alkali metal chloride. When the slurry is a sodium chloride-sodium hydroxide slurry, the slurry contains from about 110 to about 150 grams per liter of sodium hydroxide and from about 120 to about 200 grams per liter of sodium chloride.

According to the method of this invention, the asbestos fibers and resin are codeposited on the liquid permeable member by inserting the liquid permeable member in the slurry and drawing a vacuum within the member. The vacuum draws the slurry through the cathode member, depositing the asbestos fibers on the external surfaces of the member. By a vacuum is meant a pressure differential between the inside of the liquid permeable member and the outside of the liquid permeable member. The vacuum draws the slurry through the cathode member, depositing the asbestos fibers on the external surfaces thereof. Typically, a vacuum of from about 15 to at least about 25 inches of mercury (360 mm Hg to about 600 mm Hg) is built up and maintained within the liquid permeable member for a period of from about 10 to about 25 minutes. In this way, a diaphragm is deposited having a weight of solids of from about 0.2 to about 0.4 pounds per square foot. According to one desirable practice, a vacuum of about 1.5 inches of mercury (36 mm Hg) is maintained for several minutes and thereafter the vacuum is increased to about 2.5 inches (60 mm Hg) for several minutes. Gradually, the vacuum is increased to about 15 inches of mercury (360 mm Hg) and maintained thereat for about 1 minute and thereafter to about 27 to 29 inches of mercury (650 to 700 mm Hg) and maintained thereat until approximately 0.2 to 0.4 pounds of asbestos per square foot of cathode area are deposited.

The amount of resin in the diaphragm, that is, the ratio of resin to total solids, is high enough to enhance the physical strength of the diaphragm but low enough to avoid formation of a continuous surface or film on the anolyte-facing surface of the diaphragm. Generally, the diaphragms prepared according to the method of this invention contain from 0.2 weight percent to about 80 weight percent resin basis total solids, that is, basis total asbestos and resin. Preferably, the diaphragms so prepared contain from about 1 weight percent resin to about 45 weight percent resin, basis total asbestos and resin. Particularly desirable diaphragms are those containing from about 1 to about 20 weight percent resin basis total weight of asbestos and resin.

The polymeric material used is not critical as long as the material used is a thermoplastic and has some chemical resistance to nascent chlorine when used in combination with asbestos. Suitable resins may be hydrocarbons, halogenated hydrocarbons, halocarbons, or copolymers thereof.

The resin or polymer may be a hydrocarbon homopolymer, e.g., polyethylene, polypropylene, polyisobutylene, and polystyrene. Alternatively, the resin or polymer may be a hydrocarbon copolymer such as a copolymer of styrene and ethylene, or a copolymer of styrene and isobutylene, or a copolymer of ethylene and isobutylene.

Alternative resins may be hydrocarbon-halocarbon copolymers having repeating units of the types:

$$\text{+}CH_2\text{-}CHR\text{+} \text{ and } \text{+}CX^{I}X^{II}\text{-}CX^{III}X^{IV}\text{+}$$

where R is hydrogen or a hydrocarbon group. $X^{I}$, $X^{II}$, $X^{III}$, and $X^{IV}$ may be hydrogen, bromine, chlorine, or fluorine. However, at least one of the X's must be a halogen. Typical halocarbon moieties useful in providing the halocarbon-hydrocarbon copolymer useful in carrying out the method of this invention include vinyl fluoride, vinylidene fluoride, trifluoroethylene, perfluoroethylene, vinyl chloride, vinylidene chloride, and chlorotrifluoroethylene.

Halocarbon moieties containing at least two halogen atoms are preferred, i.e., vinylidene chloride, vinylidene fluoride, trifluoroethylene, chlorotrifluoroethylene, and perfluoroethylene. Particularly preferred halocarbon moieties are trifluoroethylene, chlorotrifluoroethylene, and perfluoroethylene.

Typically, the hydrocarbon moiety is ethylene or butylene. Ethylene is preferred because of the lower cost of ethylene-containing polymers relative to propylene- or butylene-containing polymers.

When a copolymer is utilized, it is particularly important that a substantial amount, e.g., from at least 20 percent to as much as 60 or even 80 mole percent of the copolymer be hydrocarbon, i.e., the addition polymerization product of an olefinic hydrocarbon.

The copolymer may be a graft copolymer, a block copolymer, an alternating copolymer, or a random copolymer. Copolymers having some degree of alternating character or of random character are preferred. One particularly outstanding halocarbon-hydrocarbon copolymer is Allied Chemical Corporation HALAR® poly(ethylene-chlorotrifluoroethylene). This is an alternating copolymer of ethylene and chlorotrifluoroethylene having a crystalline melting point of 383° F. (245° C.) and available as a pellet, powder, sheet or fiber.

According to an alternative exemplification of this invention, the polymer may be a homopolymer of an olefinic halocarbon having the empirical formula:

$$\text{+}CY^{I}Y^{II}\text{-}CY^{III}Y^{IV}\text{+}$$

where $Y^{I}$ is a halogen chosen from the group consisting of fluorine, chlorine, and bromine, and preferably from the group consisting of fluorine and chlorine. $Y^{II}$, $Y^{III}$, and $Y^{IV}$ are chosen from the group consisting of fluorine, chlorine, bromine, and hydrogen. One of the members $Y^{II}$, $Y^{III}$, and $Y^{IV}$ may be hydrogen. Typical homopolymers contemplated in the method of this invention include polyvinyl chloride, polyvinylidene chloride, polytrichloroethylene, poly(1-chloro-2-difluoroethylene), poly(1-chloro-1,2-difluoroethylene), polytrifluoroethylene, polyvinyl fluoride, and polyvinylidene fluoride.

While the method of this invention is illustrated with respect to various polymeric materials illustrated above, the method of this invention is also applicable to polymeric materials where one of the X's or one of the Y's, as described above, is an ion-exchange group. Such ion-exchange groups are represented by the general formula $-R_f-A$ where $R_f$ is $-(C_2F_4)_m-O_p-(C_2F_4)_n$ where m, n, and p are whole numbers from 0 to 2, and A is an acid group chosen from sulfonic acid groups, sulfonamide groups, carboxylic acid groups, phosphoric acid groups, and phosphonic acid groups. Most frequently, m, n, and p are each 1, and A is either a sulfonic acid group, a sulfonamide group, or a carboxylic acid group.

The liquid permeable member on which the asbestos fibers and resin are deposited is generally the cathode. However, the liquid permeable member may also be a member interposed between the anode and the cathode for carrying the diaphragm spaced from the cathode, e.g., where air or oxygen or another reactant is to be introduced between the diaphragm and the cathode.

The cathode member is generally an alkali-resistant, catholyte-resistant, hydrogen-resistant, electroconductive metal member having low hydrogen overvoltage. Most commonly, iron or steel is used in fabricating the cathode member although stainless steel, cobalt, nickel, or chromium may be used as alloys in the fabrication thereof.

The cathode member is further characterized in that it is liquid permeable, i.e., electrolyte permeable and gas permeable. The property of permeability may be provided by using a foraminous cathode, e.g., a wire mesh cathode or by using a perforated plate cathode. The cathode itself is in the form of a liquid permeable body containing a pair of foraminous sheets spaced from and substantially parallel to each other. The sheets are normally joined together with three edges and open at a fourth edge whereby to from a finger or blade-like structure.

Diaphragm cells useful for the electrolysis of brines in the formation of chlorine and alkali metal hydroxide have an anolyte chamber and a catholyte chamber as defined hereinabove. The anolyte chamber contains an anolyte solution of alkali metal chloride at a pH of from about 3 to about 4.5. Inside the anolyte chamber is an anode at which chlorine is evolved. The catholyte chamber of a diaphragm cell contains from about 100 to about 200 grams per liter alkali metal hydroxide and from about 120 to about 300 grams per liter of alkali metal chloride. Alkali metal hydroxide is formed in the catholyte and hydrogen gas is evolved at the cathode.

In the operation of a sodium chloride diaphragm cell, sodium chloride brine containing approximately 300 to 325 grams per liter sodium chloride is fed into the anolyte chamber. At the anode, the reaction $2Cl^- \rightarrow Cl_2 + 2e^-$ takes place.

The anolyte liquor passes from the anolyte chamber through the diaphragm, as described above, into the catholyte chamber, where a catholyte product containing from approximately 110 to approximately 150 grams per liter of sodium hydroxide and from approximately 120 to approximately 200 grams per liter of sodium chloride is recovered.

According to the method of this invention, a slurry is prepared containing about 120 grams per liter of sodium hydroxide, about 150 grams per liter of sodium chloride, and about 2 weight percent total solids. The solids contain about 9 weight percent Allied Chemical Corporation HALAR® 5004 alternating ethylene-chlorotrifluoroethylene copolymer and about 1 weight percent surfactant where the weight percent of surfactant is based upon the weight of the polymer.

A cathode unit substantially as shown in FIG. 4 having two rows of fifteen cathode fingers, each cathode finger being $\frac{7}{8}$ inch (2.2 cm) by 26 inches (66 cm) by 18 inches (46 cm) fabricated of 6 mesh Number 13 steel wire gauge (0.092 inch, 2.34 mm). The two rows are on opposite faces of the unit. The cathode unit is inserted into the tank of the slurry and a vacuum of about 1.5 inches of mercury (36 mm Hg) is drawn inside the cathode for about 3 minutes. This vacuum is then increased to about 2.5 inches of mercury (60 mm Hg) and maintained thereat until the level of slurry in the tank has fallen by about 2 inches (5 cm). Thereafter, the vacuum is increased to 15 inches of mercury (360 mm Hg) and maintained thereat for about 1 minute. The cathode is then drawn up from the slurry and redeposited in the slurry without breaking the surface of the slurry. The vacuum is then increased to 29 inches of mercury (690 mm Hg) and the cathode is slowly added into the slurry tank as the slurry is drawn through the cathode in order to maintain a constant head of slurry above the cathode. This is continued until a diaphragm weight of approximately 0.35 pounds of solids per square foot of cathode area is deposited on the cathode. The cathode is then withdrawn from the slurry and loose slurry drains into the tank. Thereafter, the cathode is lowered back into the slurry tank, still at a vacuum of 29 inches of mercury (690 mm Hg), and maintained submerged in the slurry for 1 minute. The cathode is then withdrawn from the slurry tank and allowed to dry in air under full vacuum for about 20 minutes.

The cathode structure 1 is then placed in a furnace 11 heated by, e.g., electrically heated forced air. A vaccum is connected to the vacuum outlet 17 of the cathode structure 1. A 5 inch vacuum (12 mm Hg) is then drawn within the cathodes 3 and the temperature within the furnace 11 is heated from ambient to about 210° F. (99° C.) and maintained at 210° F. (99° C.) for about 6 hours while a vacuum of about 5 inches (12 mm Hg) is maintained through vacuum line 17 within the cathode fingers 3 and between the cathode back screen 5 and the structure body 7 of the cathode unit 1. During this time, the relative humidity of the air drawn through the cathode fingers 3 decreases from about 90 percent relative humidity to about 20 percent relative humidity and an absolute humidity of 0.08 to 0.10 pounds of moisture per pound of dry air. At the end of 6 hours, the temperature is increased to about 220° F. (104° C.) and maintained thereat for about 6 hours. During this time, the relative humidity of the air drawn through the vacuum line 17 decreases from about 20 percent relative humidity to about 1 percent relative humidity and an absolute humidity of less than 0.08 pounds of moisture per pound of dry air. Thereafter, the temperature of the oven air is increased evenly at the rate of 20° F. (11° C.) per hour from about 220° F. (104° C.) to about 400° F. (240° C.) over a period of 9 hours. When the temperature of the oven air attains 400° F. (240° C.), the vacuum is turned off in order to avoid the possibility of drawing molten polymer from one side of the diaphragm through to the other side. The temperature of the oven air is increased until it is above the melting point of the resin and it is maintained thereat for about one-half hour. The temperature is maintained above the melting point of the resin for in excess of 1½ hours and thereafter is allowed to cool to below the melting point of the resin.

At this time, the cathode structure 1, having a resin-reinforced asbestos diaphragm substantially free of blisters and holes on the cathode fingers 3 and back screen 5, is allowed to cool in air to the ambient temperature and is then removed from the furnace. The resulting diaphragm has salt crystals resulting in a low porosity. It is, therefore, desirable to start up the cell after cell assembly by filling the anolyte chamber with water and subsequently with brine in order to flow dilute brine through the diaphragm dissolving the salt before the cell is cut into the circuit.

The following example is illustrative.

EXAMPLE

A series of tests were conducted to determine the effect of drawing a vacuum during drying on a series of diaphragms drawn from a slurry of asbestos and Allied Chemical HALAR® alternating ethylene-chlorotrifluoroethylene resin in aqueous sodium hydroxide-sodium chloride solution.

The slurries contained 1.6 to 1.9 weight percent solids in an aqueous solution of 115 to 135 grams per liter of sodium hydroxide and 175 to 200 grams per liter of sodium chloride. The solids were Johns-Manville CHLOROBESTOS® 25 asbestos, Allied Chemical Company HALAR® 5004 alternating ethylene-chlorotrifluoroethylene polymer powder, and DuPont MERPOL® SE surfactant. The concentration of the ethylene-chlorotrifluoroethylene is as shown in Tables III–VI below and the concentration of the surfactant was one weight percent, basis weight of the ethylene-chlorotrifluoroethylene.

The diaphragms were deposited on the cathodes by placing an individual cathode unit into a tank of the slurry, drawing a vacuum on the cathode, and drawing the slurry through the foraminous surfaces of the cathode.

The diaphragm deposition was accomplished by filling the drawing tank with 2,000 gallons of the slurry and submerging the cathode in the slurry so as to provide at least 2 inches of slurry above the highest foraminous areas of the cathode. Drawing is started by drawing a vacuum of 1.5 inches of mercury within the cathode. After three minutes, the vacuum is increased to 2.5 inches of mercury and maintained at 2.5 inches of mercury until a film of fibers is present on the foraminous surfaces of the cathode. Thereafter, the vacuum is increased to 15 inches of mercury for one minute and then to over 25 inches of mercury. The cathodes are maintained in the slurry under a vacuum of over 25 inches of mercury for about 10 minutes so as to deposit from about 0.3 to about 0.4 pounds of asbestos per square foot of foraminous cathode area.

Thereafter, the cathodes are removed from the slurry tank and, still under a vacuum of over 25 inches of mercury, allowed to dry at a temperature of about 65° to 75° F. for about 20 minutes.

The diaphragms were then dried according to one of two drying cycles. In one drying cycle, no vacuum was applied to cathode during drying. The drying cycle without vacuum was carried out as follows:

1. The cathode assembly with the deposited diaphragm was placed in an oven and the air feed to the oven was heated from ambient temperature to 200° F. over a period of two hours.
2. The oven air temperature was then increased from 200° F. to 220° F. over one hour and maintained at 220° F. for five hours.
3. The oven air temperature was then increased from 220° F. to 480° F. over 13 hours at the rate of 20 Fahrenheit degrees per hour and from 480° F. to 532° F. in one hour. The oven air temperature was then maintained at 532° F. until the cathode and diaphragm attained a temperature of 530° F. and maintained thereat for 1-½ hours.
4. The cathode and diaphragm were then cooled to 464° F., the melting point of Allied Chemical Co. HALAR® 5004 alternating ethylene-chlorotrifluoroethylene, over a period of 20 minutes.
5. Thereafter the cathode and diaphragm were cooled naturally to ambient temperature. The resulting diaphragms were blistered.
6. After heating, the cathode units were then reinserted in a slurry of 1.5 to 1.9 weight percent Johns-Manville CHLOROBESTOS® 25 asbestos in aqueous cell liquor to deposit a second cost containing from 0.03 to 0.045 pounds of asbestos per square foot atop the diaphragm.

In the other drying cycle, the drying was carried out while applying a vacuum to the cathode assembly. The alternative drying cycle with vacuum was carried out as follows:

1. The cathode assembly with a deposited diaphragm was placed in an oven. A vacuum of 5 inches of mercury was applied to the cathode and diaphragm. The oven air temperature was heated from ambient to 210° F. over a period of two hours and maintained at 210° F. for two hours.
2. The oven air temperature was then increased to 220° F. and maintained at 220° F. until the relative humidity of the air in the vacuum line was below about 1 percent. This took about six hours.
3. The oven air temperature was then increased from 220° F. to 400° F. at the rate of 20 Fahrenheit degrees per hour for nine hours. When a temperature of 400° F. was attained, the vacuum pump was turned off.
4. The oven air temperature was then increased at the rate of 20° F. per hour for four hours from 400° F. to 480° F. and 480° F. to 532° F. in one hour.
5. The oven air temperature was maintained at 532° F. until the diaphragm reached 530° F., about one-half hour. The diaphragm was then maintained at 530° F. for about 1-½ hours.
6. The diaphragm was then cooled to 464° F. in 20 minutes and thereafter allowed to cool naturally to ambient temperature. The resulting diaphragms appeared to be free of blisters.
7. After heating, the cathode units were then reinserted in a slurry of 1.5 to 1.9 weight percent Johsn-Manville CHLOROBESTOS® 25 asbestos in aqueous cell liquor to deposit a second coat containing from 0.03 to 0.045 pounds of asbestos per square foot.

The heating cycle with vacuum is shown in Table I and in the "oven temperature" curves of FIGS. 1 and 3. The calculated water removal with vacuum is shown in Table II and in the "accumulative percentage of water removed" curves of FIGS. 2 and 3.

The electrolytic cells were then assembled by placing the cathode units atop the anode equipped base members so that the anode fingers extended upward between the cathode fingers. Then the cell top was placed atop the cathode unit.

The cells were started up by filling the anolyte compartment with water up to a level above the top of the cathode fingers. Thereafter, saturated brine was fed to the anolyte compartment and dilute brine was recovered from the catholyte compartment for 1-½ hours prior to start up.

Current was then passed through the cell. The results are shown in Tables III through VI.

The data was statistically analyzed. At the 99 percent level of significance, the vacuum treated, resin-containing asbestos diaphragm had a lower voltage than both nonresin-containing asbestos diaphragms and resin-containing asbestos diaphragms dried at ambient pressure without forced convection of air through the diaphragm.

TABLE I

| | | | Air Into Oven | | Air Out of Oven Through Exhaust | | | Air Out of Oven Through Vacuum Line | | | | Inside Oven | |
|---|---|---|---|---|---|---|---|---|---|---|---|---|---|
| | Cumulative Time | Bar. Press. Inches of Mercury | Wet-Bulb °F. | Dry-Bulb °F. | Wet-Bulb °F. | Dry-Bulb °F. | Velocity ft/min | Wet-Bulb °F. | Dry-Bulb °F. | Vacuum Inches of Mercury | Velocity ft/min | Air Temp. °F. | Cath. Temp. °F. |
| Oven On | 00:00 | | | | | | | | | | | 72 | 68 |
| | 00:05 | 29.38 | 57 | 62 | 64 | 78 | 570 | | | | | | |
| Vacuum Pump On | 00:10 | | | | | | | | | 8.2 | | | |
| | 00:25 | | | | 80 | 110 | | | | | | | |
| | 00:40 | 29.38 | 57 | 62 | 88 | 120 | 570 | 83 | 103 | 8.5 | 138 | 150 | 133 |
| | 00:55 | | | | 94 | 126 | | | | 8.7 | | 167 | 150 |
| | 01:10 | 29.38 | 57 | 64 | 93 | 140 | 570 | 105 | 129 | 9.0 | 150 | 180 | |
| | 01:25 | | | | 90 | 148 | | 120 | 146 | 9.5 | 170 | | |
| | 01:40 | 29.38 | 57 | 64 | 90 | 156 | | 131 | 153 | 9.8 | | 202 | |
| | 01:55 | 29.37 | 59 | 68 | 90 | 161 | 620 | 143 | 165 | 9.9 | 178 | 209 | 195 |
| | 02:10 | 29.37 | 55 | 64 | 90 | 163 | | 150 | 171 | 9.9 | 194 | 211 | |
| | 02:25 | | | | 89 | 162 | | | | | | 209 | |
| | 02:40 | 29.37 | 55 | 65 | 89 | 162 | | 155 | 176 | 9.8 | 197 | 209 | |
| | 02:55 | | | | 89 | 163 | | | | | | 210 | |
| | 03:10 | 29.36 | 55 | 65 | 89 | 165 | | | | 9.9 | 202 | 212 | |
| | 03:25 | | | | 89 | 165 | | | | | | 211 | |
| | 03:40 | 29.36 | 56 | 68 | 88 | 165 | 620 | 157 | 179 | 9.5 | 200 | 210 | 207 |
| | 04:10 | 29.35 | 55 | 67 | 88 | 165 | | 157 | 177 | 9.1 | 220 | 211 | |
| | 05:10 | 29.33 | 54 | 66 | 87 | 165 | | 154 | 171 | 7.5 | 238 | 210 | |
| | 06:10 | 29.32 | 54 | 59 | 88 | 164 | | 152 | 164 | 6.0 | 320 | 210 | |
| | 07:10 | 29.30 | 53 | 56 | 88 | 164 | | 149 | 165 | 4.7 | 280 | 210 | |
| | 07:40 | | | | | | | | | 4.2 to 6.0 | | | 207 |
| | 08:10 | 29.30 | 52 | 54 | 88 | 165 | | 143 | 167 | 5.0 | 280 | 211 | 207 |
| | 09:10 | 29.31 | 53 | 55 | 88 | 165 | | 140 | 168 | 4.2 | 340 | 210 | |
| | 09:40 | | | | | | | | | 4.0 to 5.8 | | | |
| | 10:10 | 29.31 | 52 | 54 | 87 | 164 | | 133 | 170 | 5.5 | 480 | 210 | |
| | 11:10 | 29.28 | 52 | 54 | 87 | 164 | | 131 | 172 | 5.0 | 480 | 210 | |
| 12:10 | 29.28 | 52 | 54 | 87 | 164 | | 126 | 171 | 5.0 | 420 | 210 | 208 | |
| | 13:10 | 29.28 | 52 | 54 | 87 | 164 | | 127 | 177 | 5.1 | 460 | 212 | |
| | 14:10 | 29.27 | 53 | 53 | 89 | 172 | | 131 | 188 | 5.1 | 550 | 222 | 219 |
| | 15:10 | 29.25 | 53 | 53 | 89 | 172 | | 131 | 193 | 5.1 | 550 | 223 | |
| | 16:10 | 29.25 | 53 | 53 | 89 | 172 | | 130 | 201 | 5.1 | 560 | 225 | 225 |
| | 17:10 | 29.24 | 52 | 53 | 89 | 174 | | 127 | 203 | 5.0 | 560 | 223 | |
| | 18:10 | 29.24 | 52 | 53 | 89 | 174 | | 122 | 203 | 4.9 | 540 | 224 | 222 |
| | 19:10 | 29.24 | 52 | 52 | 90 | 178 | | 122 | 207 | 4.9 | 580 | 227 | |
| | 19:50 | | | | | | | | | 4.8 to 5.1 | | | |
| | 20:10 | 29.24 | 53 | 54 | 91 | 184 | | 123 | 216 | 5.2 | 640 | 241 | |
| | 21:10 | 29.25 | 53 | 53 | 91 | 184 | | 116 | 217 | 5.4 | 640 | 240 | 238 |
| | 22:10 | 29.25 | 54 | 54 | 92 | 189 | | 111 | 218 | 5.6 | 630 | 242 | 240 |
| | 22:40 | | | | | | | | | | | | |
| | 23:30 | 29.25 | 55 | 57 | 96 | 204 | 390 | 112 | 237 | 5.9 | 660 | 270 | 266 |
| | 24:50 | 29.25 | 55 | 57 | 98 | 218 | | 110 | 261 | 6.2 | 690 | 300 | 295 |
| | 25:50 | 29.24 | 55 | 58 | 100 | 228 | | 109 | 279 | 6.5 | 690 | 320 | 314 |
| 26:50 | 29.20 | 55 | 58 | 102 | 239 | 390 | 104 | 294 | 6.5 | 630 | 341 | 335 | |

TABLE II

| Cumulative Time | Control Temp., °F. | Vacuum Inches of Mercury | Water Removed Thru Vac. Line, Lbs. | Accumul. Removed Thru Vac. Line, Lbs. | Water Removed Thru Exhaust Line, Lbs. | total Water Removed Lbs. | Accumul. Water Removed Lbs. | Accumul. % of Water Removed | Vac. Line Rate Pounds Per Hour | Exhaust Line Rate Pounds Per Hour | Total Rate Pounds Per Hour |
|---|---|---|---|---|---|---|---|---|---|---|---|
| 55 min. | 2–167 | 8.5 | 0.40 | 0.40 | 6.94 | 7.34 | 7.34 | 2.68 | 0.44 | 7.64 | 8.08 |
| 1 hr/25 min. | 167–191 | 9.0 | 0.59 | 0.99 | 8.65 | 9.24 | 16.58 | 6.05 | 1.19 | 17.29 | 18.48 |
| 1 hr/55 min. | 191–209 | 9.8 | 1.62 | 2.61 | 4.75 | 6.37 | 22.95 | 8.38 | 3.23 | 9.51 | 12.74 |
| 2 hr/25 min. | 211 | 9.9 | 2.89 | 5.50 | 4.35 | 7.24 | 30.19 | 11.02 | 5.77 | 8.71 | 14.48 |
| 2 hr/55 min. | 209 | 9.8 | 3.32 | 8.82 | 3.88 | 7.20 | 37.39 | 13.65 | 6.65 | 7.76 | 14.41 |
| 3 hr/25 min. | 212 | 9.9 | 3.56 | 12.38 | 3.87 | 7.43 | 44.82 | 16.36 | 7.12 | 7.73 | 14.85 |
| 3 hr/55 min. | 210 | 9.5 | 3.53 | 15.91 | 2.66 | 6.19 | 51.01 | 18.62 | 7.05 | 5.32 | 12.37 |

TABLE II-continued

| Cumulative Time | Control Temp., °F. | Vacuum Inches of Mercury | Water Removed Thru Vac. Line, Lbs. | Accumul. Removed Thru Vac. Line, Lbs. | Water Removed Thru Exhaust Line, Lbs. | total Water Removed Lbs. | Accumul. Water Removed Lbs. | Accumul. % of Water Removed | Vac. Line Rate Pounds Per Hour | Exhaust Line Rate Pounds Per Hour | Total Rate Pounds Per Hour |
|---|---|---|---|---|---|---|---|---|---|---|---|
| 4 hr/40 min. | 211 | 9.1 | 5.86 | 21.77 | 4.47 | 10.31 | 61.32 | 22.38 | 7.81 | 5.93 | 13.74 |
| 5 hr/40 min. | 210 | 7.5 | 7.90 | 29.67 | 5.32 | 13.22 | 74.54 | 27.20 | 7.90 | 5.32 | 13.22 |
| 6 hr/40 min. | 210 | 6.0 | 10.12 | 39.79 | 4.71 | 14.83 | 89.37 | 32.62 | 10.12 | 4.71 | 14.83 |
| 7 hr/40 min. | 210 | 4.7 | 6.67 | 46.46 | 4.72 | 11.39 | 100.76 | 36.77 | 6.67 | 4.72 | 11.39 |
| 8 hr/40 min. | 211 | 5.0 | 6.93 | 53.39 | 3.74 | 10.67 | 111.43 | 40.67 | 6.93 | 3.74 | 10.67 |
| 9 hr/40 min. | 210 | 4.2 | 7.48 | 60.87 | 3.74 | 11.22 | 122.65 | 44.76 | 7.48 | 3.74 | 11.22 |
| 10 hr/40 min. | 210 | 5.5 | 8.50 | 69.37 | 2.91 | 11.41 | 134.06 | 48.93 | 8.50 | 2.91 | 11.41 |
| 11 hr/40 min. | 210 | 5.0 | 7.83 | 77.20 | 2.90 | 10.73 | 144.79 | 52.84 | 7.83 | 2.90 | 10.73 |
| 12 hr/40 min. | 210 | 5.0 | 5.84 | 83.04 | 2.91 | 8.75 | 153.54 | 56.04 | 5.84 | 2.91 | 8.75 |
| 13 hr/40 min. | 210–217 | 5.1 | 6.47 | 89.51 | 2.90 | 9.37 | 162.91 | 59.46 | 6.47 | 2.90 | 9.37 |
| 14 hr/40 min. | 217–222 | 5.1 | 6.57 | 96.08 | 2.38 | 8.95 | 171.86 | 62.72 | 6.57 | 2.38 | 8.95 |
| 15 hr/40 min. | 223 | 5.1 | 6.43 | 102.51 | 2.39 | 8.82 | 180.68 | 65.94 | 6.43 | 2.39 | 8.82 |
| 16 hr/40 min. | 225 | 5.1 | 8.03 | 110.54 | 2.39 | 10.42 | 191.10 | 69.74 | 8.03 | 2.39 | 10.42 |
| 17 hr/40 min. | 223 | 5.0 | 7.15 | 117.69 | 2.62 | 9.77 | 200.87 | 73.31 | 7.15 | 2.62 | 9.77 |
| 18 hr/40 min. | 224 | 4.9 | 5.64 | 123.33 | 2.62 | 8.26 | 209.13 | 76.32 | 5.64 | 2.62 | 8.26 |
| 19 hr/40 min. | 227 | 4.9 | 5.99 | 129.32 | 3.30 | 9.29 | 218.42 | 79.72 | 5.99 | 3.30 | 9.29 |
| 20 hr/40 min. | 230–240 | 5.2 | 6.65 | 135.97 | 2.46 | 9.11 | 227.53 | 83.04 | 6.65 | 2.46 | 9.11 |
| 21 hr/40 min. | 240 | 5.4 | 4.80 | 140.77 | 2.46 | 7.26 | 234.79 | 85.69 | 4.80 | 2.46 | 7.26 |
| 22 hr/40 min. | 241–250 | 5.6 | 3.59 | 144.36 | 2.78 | 6.37 | 241.16 | 88.01 | 3.59 | 2.78 | 6.37 |
| 24 hr/20 min. | 250–290 | 5.9 | 6.09 | 150.45 | 5.57 | 11.66 | 252.82 | 92.27 | 3.65 | 3.34 | 6.99 |
| 25 hr/20 min. | 290–310 | 6.2 | 2.81 | 153.26 | 3.69 | 6.50 | 259.32 | 94.64 | 2.81 | 3.69 | 6.50 |
| 26 hr/20 min. | 310–330 | 6.5 | 2.24 | 155.50 | 3.48 | 5.72 | 265.04 | 96.73 | 2.24 | 3.48 | 5.72 |
| 27 hr/20 min. | 330–350 | 6.5 | 0.84 | 156.34 | 3.38 | 4.22 | 269.26 | 98.27 | 0.84 | 3.38 | 4.22 |

TABLE III

| | Cathode Units Heated Without Application of Vacuum | | | |
|---|---|---|---|---|
| | Cells with Diaphragms Containing 8.85 Weight % Resin | Cells with Diaphragms Containing 5.62 Weight % Resin | Cells with Diaphragms Containing 3.3 Weight % Resin | Cells with Diaphragms Containing No Resin |
| Diaphragm age, days | 242 | 215 | 183 | 222 |
| Diaphragm Weight (asbestos + HALAR® ethylene-chlorotrifluoroethylene resin) lb/ft$^2$ | 0.36 | 0.33 | 0.36 | 0.35 |
| | 8.85 | 5.62 | 3.36 | 0.00 |
| Number of Cells Top-coated With Asbestos | None | 3 | 5 | None |
| Average Number of Times Asbestos Added to Cells | 4.3 | 3.6 | 2.2 | 1.4 |
| Cell Voltage + 30 KA (150 amps per square foot) | 3.48 | 3.53 | 3.65 | 3.41 |
| Cell Liquor: Grams/liter NaOH | 133.8 | 139.2 | 151.2 | 136.7 |
| Salt/Caustic Ratio | 1.49 | 1.50 | 1.35 | 1.36 |
| Anode Current Efficiency | 92.3 | 90.4 | 92.7 | 94.8 |
| DC KWH/Ton of $Cl_2$ | 2591 | 2690 | 2704 | 2464 |

TABLE IV

| | Cells With Vacuum Baked HALAR® Diaphragms Containing 9 Weight Percent Resin | | | | | |
|---|---|---|---|---|---|---|
| Diaphragm Weight (asbestos + HALAR® ethylene-chlorotrifluoroethylene resin) lb/ft$^2$ | 0.40 | 0.38 | 0.39 | 0.36 | 0.36 | 0.35 |
| Asbestos Topcoat lb/ft$^2$ | 0.02 | 0.02 | 0.04 | 0.04 | 0.04 | 0.04 |
| Asbestos Additions | 5 | 2 | None | 3 | None | 2 |
| Cell Voltage at 30 KA (150 amps per square foot) | 3.28 | 3.19 | 3.22 | 3.25 | 3.34 | 3.28 |
| Cell Liquor: Grams/liter NaOH | 130.7 | 127.6 | 132.1 | 123.4 | 136.7 | 124.5 |
| Salt/Caustic Ratio | 1.48 | 1.50 | 1.44 | 1.64 | 1.37 | 1.61 |
| Anode Current Efficiency | 93.3 | 94.6 | 94.5 | 96.6 | 96.2 | 96.7 |

TABLE IV-continued

| | Cells With Vacuum Baked HALAR® Diaphragms Containing 9 Weight Percent Resin | | | | | |
|---|---|---|---|---|---|---|
| DC KWH/Ton of $Cl_2$ | 2415 | 2313 | 2339 | 2311 | 2380 | 2322 |

TABLE V

| | Cells With Vacuum Baked Diaphragms Containing 5.7 Weight Percent Resin | | |
|---|---|---|---|
| Diaphragm Weight (asbestos + HALAR® ethylene-chlorotrifluoroethylene resin) lb/ft$^2$ | 0.32 | 0.39 | 0.35 |
| Asbestos Topcoat lb/ft$^2$ | 0.03 | 0.05 | 0.05 |
| Asbestos Additions | 1 | None | None |

TABLE V-continued

| Cells With Vacuum Baked Diaphragms Containing 5.7 Weight Percent Resin | | | |
|---|---|---|---|
| Cell Voltage + 30 KA (150 amps per square foot) | 3.33 | 3.29 | 3.33 |
| Cell Liquor: | | | |
| Grams/Liter NaOH | 129.1 | 132.2 | 117.2 |
| Salt/Caustic Ratio | 1.46 | 1.39 | 1.68 |
| Anode Current Efficiency | 92.6 | 93.2 | 96.7 |
| DC KWH/Ton of $Cl_2$ | 2466 | 2421 | 2362 |

TABLE VI

| | Average of 6 Cells With Vacuum Baked Diaphragm Containing 9 Weight % Resin | Average of 3 Cells With Vacuum Baked Diaphragm Containing 5.7 Weight % Resin | Average of 9 Control Cells Without Resin |
|---|---|---|---|
| Diaphragm Weight (asbestos + HALAR® ethylene-chlorotrifluoroethylene resin) lb/ft$^2$ | 0.37 | 0.35 | 0.35 |
| Asbestos Topcoat lb/ft$^2$ | 0.033 | 0.043 | None |
| Cell Voltage + KA (150 amps per square foot) | 3.26 | 3.32 | 3.43 |
| Cell Liquor: | | | |
| Grams/liter NaOH | 129.2 | 126.2 | 132.8 |
| Salt/Caustic Ratio | 1.51 | 1.51 | 1.42 |
| Anode Current Efficiency | 95.3 | 94.2 | 96.5 |
| DC KWH/Ton of $Cl_2$ | 2347 | 2416 | 2438 |

While the method of this invention has been described with respect to drawing heated air through the asbestos diaphragm, the method of this invention may also be advantageously practiced in electrolytic cells having fingered cathodes by drawing air into the catholyte chamber, i.e., into the fingers and into the space between the cathode back screen and the body of the cathode unit. In this way, air is caused to move rapidly past the surface of the diaphragm that is in contact with the cathode. This may be accomplished by providing a bleed hole or opening in the cathode unit.

The method of this invention is useful in preparing resin reinforced asbestos diaphragms for both monopolar cells substantially as shown in FIG. 4 and for bipolar cells.

We claim:

1. In a method of preparing a resin containing asbestos diaphragm comprising the steps of depositing asbestos fibers and resin from an aqueous slurry comprising alkali metal chloride, alkali metal hydroxide, asbestos fibers, and resin onto a liquid permeable cathode member and thereafter heating the deposited asbestos fibers and resin to cause the resin to bind the asbestos fibers together, the improvement comprising maintaining forced convective flow of air through the diaphragm at a temperature below the boiling temperature of entrained water within the diaphragm and at a flow rate high enough to avoid saturating the air and low enough to avoid damage to the diaphragm until the diaphragm is substantially free of entrained water whereby to avoid boiling the entrained water and thereafter heating the diaphragm to cause the resin to bind the asbestos fibers together.

2. The method of claim 1 wherein the resin is selected from the group consisting of:

(a) hydrocarbon resins;

(b) homopolymers having the empirical formula $\leftarrow CY^{I}Y^{II}-CY^{III}Y^{IV}\rightarrow$; and (c) copolymers having hydrocarbon and halocarbon moieties wherein the halocarbon moiety is chosen from the group consisting of halocarbons having the empirical formula $\leftarrow CX^{I}X^{II}-CX^{III}X^{IV}\rightarrow$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen, and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ and chosen from the group consisting of fluorine, chlorine, bromine, hydrogen, and acid groups.

3. The method of claim 2 wherein the resin is a copolymer of a hydrocarbon and a halocarbon selected from the group consisting of perfluoroethylene, trifluoroethylene, vinylidene fluoride, vinylidene chloride, and chlorotrifluoroethylene.

4. The method of claim 3 wherein the resin is an alternating copolymer of ethylene and chlorotrifluoroethylene.

5. The method of claim 2 wherein the resin is a homopolymer chosen from the group consisting of polyvinyl chloride, polyvinylidene chloride, polytrichloroethylene, poly(1-chloro-2,2-difluoroethylene), poly(1-chloro-1,2-difluoroethylene), polytrifluoroethylene, polyvinyl fluroride, poly(vinylidene fluoride), polyethylene, polypropylene, polyisobutylene, and polystyrene.

6. The method of claim 1 wherein said liquid permeable cathode member comprises a pair of foraminous sheets spaced from and substantially parallel to each other, said sheets being joined together at three edges and open at the fourth edge whereby to form a liquid permeable finger having an open base.

7. The method of claim 6 comprising heating the deposited asbestos fibers and resin from ambient temperature to the melting temperature of the resin and maintaining a vacuum within said liquid permeable finger while the deposited asbestos and resin is above 100° F. until the deposited asbestos and resin is substantially free of entrapped water.

8. The method of claim 1 wherein the temperature of the air passed through the diaphragm is maintained below about 104° C. until the absolute humidity of the air recovered from the diaphragm is less than 0.10 pound of moisture per pound of dry air.

9. The method of claim 8 wherein the temperature of the air is thereafter raised at a low enough rate to maintain the absolute humidity of the air recovered from the diaphragm below about 0.10 pound of moisture per pound of dry air.

10. The method of claim 9 comprising raising the temperature of the air at a rate of about 11 Centigrade degrees per hour.

11. The method of claim 1 wherein the deposited diaphragm contains from about 5 to about 20 weight percent resin, basis total asbestos fibers and resin.

12. The method of claim 1 comprising maintaining said diaphragm at a temperature below 212° F. and drawing air through said diaphragm until the air drawn through said diaphragm has a relative humidity less than 20 percent.

13. In a method of preparing a resin containing asbestos diaphragm comprising the steps of depositing asbestos fibers and resin from an aqueous slurry comprising alkali metal chloride, alkali metal hydroxide, asbestos fibers, and resin onto a liquid permeable cathode member, and thereafter heating the deposited asbestos fibers and resin to cause the resin to bond the asbestos fibers together, the improvement comprising maintaining forced convective flow of heated air through the diaphragm at a flow rate high enough to avoid saturation of the air and low enough to avoid damage to the diaphragm, and at a temperature below 212° F., and recovering the air passed through the diaphragm, until the relative humidity of the air passed through the diaphragm and recovered is less than 21 percent and thereafter heating the diaphragm to cause the resin to bind the asbestos fibers together.

14. The method of claim 13 wherein the temperature of the air passed through the diaphragm is maintained below about 104° C. until the absolute humidity of the air recovered from the diaphragm is less than 0.10 pound of moisture per pound of dry air.

15. The method of claim 14 wherein the temperature of the air is thereafter raised at a low enough rate to maintain the absolute humidity of the air recovered from the diaphragm below about 0.10 pound of moisture per pound of dry air.

16. The method of claim 15 comprising raising the temperature of the air at a rate of about 11 Centigrade degrees per hour.

17. The method of claim 13 wherein the resin is a copolymer of a hydrocarbon and a halocarbon selected from the group consisting of perfluoroethylene, trifluoroethylene, vinylidene fluoride, vinylidene chloride, and chlorotrifluoroethylene.

18. The method of claim 17 wherein the resin is an alternating copolymer of ethylene and chlorotrifluoroethylene.

19. The method of claim 13 wherein said liquid permeable cathode member comprises a pair of foraminous sheets spaced from and substantially parallel to each other, said sheets being joined together at three edges and open at the fourth edge whereby to form a liquid permeable finger having an open base.

20. The method of claim 19 comprising heating the deposited asbestos fibers and resin from ambient temperature to the melting temperature of the resin, and maintaining a vacuum within said liquid permeable finger while the deposited asbestos and resin is above 100° F. until the deposited asbestos and resin is substantially free of entrapped water.

21. The method of claim 13 wherein the resin is selected from the group consisting of:

(a) hydrocarbon resins;

(b) homopolymers having the empirical formula $+CY^{I}Y^{II}-CY^{III}Y^{IV}+$; and (c) copolymers having hydrocarbon and halocarbon moieties wherein the halocarbon moiety is chosen for the group consisting of halocarbons having the empirical formula $+CX^{I}X^{II}-CX^{III}X^{IV}+$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of fluorine, chlorine, bromine, hydrogen and acid groups.

22. The method of claim 13 wherein the resin is a homopolymer chosen from the group consisting of polyvinyl chloride, polyvinylidene chloride, polytrichloroethylene, poly(1-chloro-2,2-difloroethylene), poly(1-chloro-1,-2-difluoroethylene), polytrifluoroethylene, polyvinyl fluoride, poly(vinylidene fluoride), polyethylene, polypropylene, polyisobutylene, and polystyrene.

23. The method of claim 13 wherein the deposited diaphragm contains from about 5 to about 20 weight percent resin, basis total asbestos fibers and resin.

24. In a method of preparing a resin containing asbestos diaphragm comprising the steps of depositing asbestos fibers and resin from an aqueous slurry comprising alkali metal chloride, alkali metal hydroxide, asbestos fibers, and resin onto a liquid permeable cathode member, and thereafter heating the deposited asbestos fibers and resin to cause the resin to bond the asbestos fibers together, the improvement comprising maintaining forced convective flow of heated air through the diaphragm below 212° F. and recovering the air passed through the diaphragm until the absolute humidity of the air recovered from the diaphragm is less than 0.1 pound of moisture per pound of dry air, heating the air to be passed through the diaphragm at a rate of about 20 Fehrenheit degrees per hour until the resin melts, and thereafter allowing the diaphragm to cool.

25. In a method of starting up an electrolytic cell having an initially low permeability resin containing asbestos diaphragm prepared by the method of claim 24, which method comprises:

(a) feeding water to said anolyte compartment to a level sufficient to wet said diaphragm;

(b) thereafter feeding brine to said anolyte compartment and withdrawing dilute brine from said catholyte compartment without the passage of electrical current through said cell whereby to increase the liquid permeability of said diaphragm; and (c) thereafter passing an electrical current through said cell.

26. In a method of preparing a resin containing asbestos diaphragm comprising the steps of depositing asbestos fibers and resins from an aqueous slurry comprising alkali metal chloride, alkali metal hydroxide, asbestos fibers, and resin onto a liquid permeable cathode member and thereafter heating the deposited asbestos fibers and resin to cause the resin to bind the asbestos fibers together wherein the resin is selected from the group consisting of:

(a) hydrocarbon resins;

(b) homopolymers having the empirical formula $-[-CY^{I}Y^{II}-CY^{III}Y^{IV}-]-$; and (c) copolymers having hydrocarbon and halocarbon moieties wherein the halocarbon moiety is chosen from the group consisting of halocarbons having the empirical formula $-[-CX^{I}X^{II}-CX^{III}X^{IV}-]-$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen, and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of fluorine, chlorine, bromine, hydrogen, and acid groups, the improvement comprising maintaining forced convective flow of air through the diaphragm at a temperature below the boiling temperature of entrained water within the diaphragm and at a flow rate high enough to avoid saturating the air and low enough to avoid damage to the diaphragm until the diaphragm is substantially free of entrained water whereby to avoid boiling the entrained water and thereafter heating the diaphragm to cause the resin to bind the asbestos fibers together.

27. The method of claim 26 wherein the temperature of the air passed through the diaphragm is maintained below about 104° C. until the absolute humidity of the air recovered from the diaphragm is less than 0.10 pound of moisture per pound of dry air.

28. The method of claim 27 wherein the temperature of the air is thereafter raised at a low enough rate to maintain the absolute humidity of the air recovered from the diaphragm below about 0.10 pound of moisture per pound of dry air.

29. The method of claim 28 comprising raising the temperature of the air at a rate of about 11 Centigrade degrees per hour.

30. The method of claim 26 wherein the resin is a copolymer of a hydrocarbon and a halocarbon sleected from the group consisting of perfluoroethylene, trifluoroethylene, vinylidene fluoride, vinylidene chloride, and chlorotirfluoroethylene.

31. The method of claim 30 wherein the resin is a an alternating copolymer of ethylene and chlorotrifluoroethylene.

32. The method of claim 26 wherein said liquid permeable cathode member comprises a pair of foraminous sheets spaced from and substantially parallel to each other, said sheets being joined together at three edges and open at the fourth edge whereby to form a liquid permeable finger having an open base.

33. The method of claim 32 comprising heating the deposited asbestos fibers and resin from ambient temperature to the melting temperature of the resin and maintaining a vacuum within said liquid permeable finger while the deposited asbestos and resin is above 100° F. until the deposited asbestos and resin is substantially free of entrapped water.

34. The method of claim 26 wherein the resin is a homopolymer chosen from the group consisting of polyvinyl chloride, polyvinylidene chloride, polytrichloroethylene, poly(1-chloro-2,2-difluoroethylene), poly(1-chloro-1,2 difloroethylene), polytrifluoroethylene, polyvinyl fluoride, poly(vinylidene fluoride), polyethylene, polypropylene, polyisobutylene, and polystyrene.

35. The method of claim 26 wherein the deposited diaphragm contains from about 5 to about 20 weight percent resin, basis total asbestos fibers and resin.

36. The method of claim 26 comprising maintaining said diaphragm at a temperature below 212° F. and drawing air through said diaphragm until the air drawn through said diaphragm has a relative humidity less than 20 percent.

37. In a method of preparing a resin containing asbestos diaphragm comprising the steps of depositing asbestos fibers and resins from an aqueous slurry comprising alkali metal chloride, alkali metal hydroxide asbestos fibers, and resin onto a liquid permeable cathode member, and thereafter heating the deposited asbestos fibers and resin to cause the resin to bond the asbestos fibers together, wherein the resin is selected from the group consisting of:

(a) hydrocarbon resins;

(b) homopolymers having the empirical formula: $-CY^{I}Y^{II}\,CY^{III}Y^{IV}-$; and (c) copolymers having hydrocarbon and halocarbon moieties wherein the halocarbon moiety is chosen from the group consisting of halocarbons having the empirical formula $-CX^{I}X^{II}-CX^{III}X^{IV}-$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen, and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of flurine, chlorine, bromine, hydrogen and acid groups; the improvement comprising maintaining forced convective flow of heated air through the diaphragm at a flow rate high enough to avoid saturation of the air and low enough to avoid damage to the diaphragm, and at a temperature below 212° F., and recovering the air passed through the diaphragm, until the relative humidity of the air passed through the diaphragm and recovered is less than 21 percent and thereafter heating the diaphragm to cause the resin to bind the asbestos fibers together.

38. The method of claim 37 wherein the temperature of the air passed through the diaphragm is maintained below about 104° C. until the absolute humidity of the air recovered from the diaphragm is less than 0.10 pound of moisture per pound of dry air.

39. The method of claim 38 wherein the temperature of the air is thereafter raised at a low enough rate to maintain the absolute humidity of the air recovered from the diaphragm below about 0.10 pound of moisture per pound of dry air.

40. The method of claim 39 comprising raising the temperature of the air at a rate of about 11 Centigrade degrees per hour.

41. The method of claim 40 wherein the resin is selected from group consisting of:

(a) hydrocarbon resins;

(b) homopolymers having the empirical formula $\text{+}CY^{I}Y^{II}\text{-}CY^{III}Y^{IV}\text{+}$; *and*

(c) copolymers having hydrocarbon and halocarbon moieties wherein the halocarbon moiety is chosen from the group consisting of halocarbons having the empirical formula $\text{+}CX^{I}X^{II}\text{-}CX^{III}X^{IV}\text{+}$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen, and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of fluorine, chlorine, bromine, hydrogen, and acid groups.

42. The method of claim 41 wherein the resin is a homopolymer chosen from the group consisting of polyvinyl chloride, polyvinylidene chloride, polytrichloroethylene, poly(1-chloro-2,2-difluoroethylene), poly (1-chloro-1,2-difluoroethylene), polytrifluoroethylene, polyvinyl fluoride, poly(vinylidene fluoride), polyethylene, polypropylene, polyisobutylene, and polystyrene.

43. The method of claim 39 wherein the resin is a copolymer of a hydrocarbon and a halocarbon selected from the group consisting of perfluoroethylene, trifluoroethylene, vinylidene fluoride, vinylidene chloride, and chlorotrifluoroethylene.

44. The method of claim 43 wherein the resin is an alternating copolymer of ethylene and chlorotrifluoroethylene.

45. The method of claim 37 wherein the resin is a copolymer of a hydrocarbon and a halocarbon selected from the group consisting of perfluoroethylene, trifluoroethylene, vinylidene fluoride, vinylidene chloride, and chlorotrifluoroethylene.

46. The method of claim 45 wherein the resin is an alternating copolymer of ethylene and chlorotrifluoroethylene.

47. The method of claim 37 wherein said liquid permeable cathode member comprises a pair of foraminous sheets spaced from and substantially parallel to each other, said sheets being joined together at three edges and open at the fourth edge whereby to form a liquid permeable finger having an open base.

48. The method of claim 47 comprising heating the deposited asbestos fibers and resin from ambient temperature to the melting temperature of the resin, and maintaining a vacuum within said liquid permeable finger while the deposited asbestos and resin is above 100° F. until the deposited asbestos and resin is substantially free of entrapped water.

49. The method of claim 37 wherein the resin is a homopolymer chosen from the group consisting of polyvinyl chloride, polyvinylidene chloride, polytrichloroethylene, poly(1-chloro-2,2-difluoroethylene), poly(1-chloro,2-difluoroethylene), polytrifluoroethylene, polyvinyl fluoride, poly(vinylidene fluoride), polyethylene, polypropylene, polyisobutylene, and polystyrene.

50. The method of claim 37 wherein the deposited diaphragm contains from about 5 to about 20 weight percent resin, basis total asbestos fibers and resin.

51. In a method of preparing a resin containing asbestos diaphragm comprising the steps of depositing asbestos fibers and resin from an aqueous slurry comprising alkali metal chloride, alkali metal hydroxide, asbestos fibers, and resin onto a liquid permeable cathode member and thereafter heating the deposited asbestos fibers and resin to cause the resin to bind the asbestos fibers together, the improvement comprising maintaining forced convective flow of air through the diaphragm at a flow rate low enough to avoid damage to the diaphragm and at a temperature below 104° C. until the absolute humidity of the air recovered from the diaphragm is less than 0.10 pound of moisture per pound of dry air, and thereafter raising the temperature of the air at a low enough rate to maintain the absolute humidity of the air recovered from the diaphragm below about 0.10 pound of moisture per pound of dry air whereby to avoid boiling the entrained water, and thereafter heating the diaphragm to cause the resin to bind the asbestos fibers together.

52. The method of claim 51 wherein said liquid permeable cathode member comprises a pair of foraminous sheets spaced from and substantially parallel to each other, said sheets being joined together at three edges and open at the fourth edge whereby to form a liquid permeable finger having an open base.

53. The method of claim 52 comprising heating the deposited asbestos fibers and resins from ambient temperature to the melting temperature of the resin and maintaining a vacuum within said liquid permeable finger while the deposited asbestos and resin is about 100° F. until the deposited asbestos and resin is substantially free of entrapped water.

54. The method of claim 51 wherein the deposited diaphragm contains from about 5 to about 20 weight percent resin, basis total asbestos fibers and resin.

55. The method of claim 51 comprising maintaining said diaphragm at a temperature below 212° F. and drawing air through said diaphragm until the air drawn through said diaphragm has a relative humidity less than 20 percent.

56. In a method of preparing a resin containing asbestos diaphragm comprising the steps of depositing asbestos fibers and resin from an aqueous slurry comprising alkali metal chloride, alkali metal hydroxide, asbestos fibers, and resin onto a liquid permeable cathode member, and thereafter heating the deposited asbestos fibers and resin to cause the resin to bond the asbestos fibers together, the improvement comprising maintaining forced convenctive flow of heated air through the diaphragm at a flow rate high enough to avoid saturation of the air and low enough to avoid damage to the diaphragm, and at a temperature below 212° F., and recovering the air passed through the diaphragm, until the relative humidity of the air passed through the diaphragm and recovered therefrom is less than 21 percent and thereafter heating the air at a low enough rate to maintain the absolute humidity of the air recovered from the diaphragm below about 0.10 pound of moisture per pound of dry air, and thereafter heating the diaphragm to cause the resin to bind the asbestos fibers together.

57. The method of claim 56 wherein the resin is selected from the group consisting of:

(a) hydrocarbon resins:

(b) homopolymers having the empirical formula $CY^{I}Y^{II}$-$CY^{III}Y^{IV}$; and (c) copolymers having hydrocarbon and halocarbon moieties wherein the halocarbon moiety is chosen from the group consisting of halocarbons having the empirical formula $CX^{I}X^{II}$-$CX^{III}X^{IV}$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of fluorine, chlorine, bromine, hydrogen, and acid groups.

58. The method of claim 57 wherein the resin is a copolymer of a hydrocarbon and a halocarbon selected from the group consisting of perfluoroethylene, trifluoroethylene, vinylidene fluoride, vinylidene chloride, and chlorotrifluoroethylene.

59. The method of claim 58 wherein the resin is an alternating copolymer of ethylene and chlorotrifluoroethylene.

60. The method of claim 57 wherein the resin is a homopolymer chosen from the group consisting of polyvinyl chloride, polyvinylidene chloride, polytrichloroethylene, poly (1-chloro-2,2-difluoroethylene), poly(1-chloro-1,2-difluoroethylene,)polytrifluoroethylene, polyvinyl fluoride, poly (vinylidene fluoride), polyethylene, polypropylene, polyisobutylene, and polystyrene.

61. The method of claim 56 wherein said liquid permeable cathode member comprises a pair of foraminous sheets spaced from and substantially parallel to each other, said sheets being joined together at three edges and open at the fourth edge whereby to form a liquid permeable finger having an open base.

62. The method of claim 61 comprising heating the deposited asbestos fibers and resin from ambient temperature to the melting temperature of the resin, and maintaining a vacuum within said liquid permeable finger while the deposited asbestos and resin is above 100° F. until the deposited asbestos and resin is substantially free of entrapped water.

63. The method of claim 56 wherein the deposited diaphragm contains from about 5 to about 20 weight percent resin, basis total asbestos fibers and resin.

64. In a method of preparing a resin containing asbestos diaphragm comprising the steps of depositing asbestos fibers and resin from an aqueous slurry comprising alkali metal chloride, alkali metal hydroxide, asbestos fibers, and resin onto a liquid permeable cathode member and thereafter heating the deposited asbestos fibers and resin to cause the resin to bind the asbestos fibers together, wherein the resin is selected from the group consisting of:

(a) hydrocarbon resins;

(b) homopolymers having the empirical formula $CY^{I}Y^{II}$-$CY^{III}Y^{IV}$; and (c) copolymers having hydrocarbon and halocarbon moieties wherein the halocarbon moiety is chosen from the group consisting of halocarbons having the empirical formula $CX^{I}X^{II}$-$CX^{III}X^{IV}$ wherein at least 20 percent of the copolymer is the hydrocarbon moiety;

where $Y^{I}$ is halogen chosen from the group consisting of fluorine, chlorine, and bromine, $Y^{II}$, $Y^{III}$, and $Y^{IV}$ are chosen from the group consisting of fluorine, chlorine, bromine, hydrogen, and acid groups, and at least one of said $Y^{II}$, $Y^{III}$, and $Y^{IV}$ is hydrogen, and where $X^{I}$ is a halogen chosen from the group consisting of fluorine, chlorine, and bromine, and $X^{II}$, $X^{III}$, and $X^{IV}$ are chosen from the group consisting of fluorine, chlorine, bromine, hydrogen, and acid groups; the hydrogen, and acid groups; the improvement comprising maintaining forced convective flow of air through the diaphragm at a temperature below 104° C. until the absolute humidity of the air recovered from the diaphragm is less than 0.10 pound moisture per pound of dry air, and thereafter raising the temperature of the air at a rate low enough to maintain the absolute humidity of the air recovered from the diaphragm below about 0.10 pound per pound of dry air, and, at a flow rate high enough to avoid saturating the air and low enough to avoid damage of the diaphragm, until the diaphragm is substantially free of entrained water whereby to avoid boiling the entrained water and thereafter heating the diaphragm to cause the resin to bind the asbestos fibers together.

65. The method of claim 64 wherein the resin is a homopolymer chosen from the group consisting of polyvinyl chloride, polyvinylidene chloride, polytrichloroethylene, poly)1-chloro-2,2-difluoroethylene), poly (1-chloro-1,2-difluoroethylene), polytrifluoroethylene, polyvinyl fluoride, poly(vinylidene fluoride), polyethylene, polypropylene, polyisobutylene, and polystyrene.

66. The method of claim 65 wherein said liquid permeable cathode member comprises a pair of foraminous sheets spaced from and substantially parallel to each other, said sheets being joined together at three edges and open at the fourth edge whereby to form a liquid permeable finger having an open base.

67. The method of claim 65 wherein said liquid permeable cathode member comprises a pair of foraminous sheets spaced from and substantially parallel to each other, said sheets being joined together at three edges and open at the fourth edge whereby to form a liquid permeable finger having an open base.

68. The method of claim 64 wherein the resin is a copolymer of a hydrocarbon and a halocarbon selected from the group consisting of perfluoroethylene, trifluoroethylene, vinylidene fluoride, vinylidene chloride, and chlorotrifluoroethylene.

69. The method of claim 68 wherein the resin is an alternating copolymer of ethylene and chlorotrifluoroethylene.

* * * * *